US008123827B2

(12) United States Patent
Robinson

(10) Patent No.: US 8,123,827 B2
(45) Date of Patent: Feb. 28, 2012

(54) PROCESSES FOR MAKING SYNGAS-DERIVED PRODUCTS

(75) Inventor: Earl T. Robinson, Lakeland, FL (US)

(73) Assignee: Greatpoint Energy, Inc., Cambridge, MA (US)

( * ) Notice: Subject to any disclaimer, the term of this patent is extended or adjusted under 35 U.S.C. 154(b) by 577 days.

(21) Appl. No.: 12/342,628

(22) Filed: Dec. 23, 2008

(65) Prior Publication Data

US 2009/0165381 A1 Jul. 2, 2009

Related U.S. Application Data

(60) Provisional application No. 61/017,305, filed on Dec. 28, 2007.

(51) Int. Cl.
*C07C 27/00* (2006.01)
*C10J 3/46* (2006.01)

(52) U.S. Cl. ..... 48/197 R; 423/650; 423/651; 423/652; 252/373; 518/702; 518/704; 518/712

(58) Field of Classification Search ..... 423/650, 423/651, 652; 252/373; 48/197 R; 518/702, 518/704, 712
See application file for complete search history.

(56) References Cited

U.S. PATENT DOCUMENTS

| | | | |
|---|---|---|---|
| 2,813,126 | A | 11/1957 | Tierney |
| 2,886,405 | A | 5/1959 | Benson et al. |
| 3,034,848 | A | 5/1962 | W.J. King |
| 3,114,930 | A | 12/1963 | Oldham et al. |
| 3,164,330 | A | 1/1965 | G. Neidl |
| 3,435,590 | A | 4/1969 | Smith |
| 3,531,917 | A | 10/1970 | Grunewald et al. |
| 3,594,985 | A | 7/1971 | Ameen et al. |
| 3,615,300 | A | 10/1971 | Holm et al. |
| 3,689,240 | A | 9/1972 | Aldridge et al. |
| 3,740,193 | A | 6/1973 | Aldridge et al. |
| 3,746,522 | A | 7/1973 | Donath |
| 3,759,036 | A | 9/1973 | White |
| 3,779,725 | A | 12/1973 | Hegarty et al. |

(Continued)

FOREIGN PATENT DOCUMENTS

| | | |
|---|---|---|
| CA | 966660 | 4/1975 |

(Continued)

OTHER PUBLICATIONS

U.S. Appl. No. 12/778,538, filed May 12, 2010, Robinson, et al.

(Continued)

*Primary Examiner* — Timothy Vanoy
(74) *Attorney, Agent, or Firm* — McDonnell Boehnen Hulbert & Berghoff LLP

(57) ABSTRACT

The present invention provides processes for making syngas-derived products. For example, one aspect of the present invention provides a process for making a syngas-derived product, the process comprising (a) providing a carbonaceous feedstock; (b) converting the carbonaceous feedstock in a syngas formation zone at least in part to a synthesis gas stream comprising hydrogen and carbon monoxide; (c) conveying the synthesis gas stream to a syngas reaction zone; (d) reacting the synthesis gas stream in the syngas reaction zone to form the syngas-derived product and heat energy, a combustible tail gas mixture, or both; (e) recovering the syngas-derived product; and (f) recovering the heat energy formed from the reaction of the synthesis gas stream, burning the combustible tail gas mixture to form heat energy, or both.

18 Claims, 1 Drawing Sheet

U.S. PATENT DOCUMENTS

| | | | |
|---|---|---|---|
| 3,814,725 | A | 6/1974 | Zimmerman et al. |
| 3,817,725 | A | 6/1974 | Sieg et al. |
| 3,828,474 | A | 8/1974 | Quartulli |
| 3,833,327 | A | 9/1974 | Pitzer et al. |
| 3,847,567 | A | 11/1974 | Kalina et al. |
| 3,876,393 | A | 4/1975 | Kasai et al. |
| 3,904,386 | A | 9/1975 | Graboski et al. |
| 3,915,670 | A | 10/1975 | Lacey et al. |
| 3,920,229 | A | 11/1975 | Piggott |
| 3,929,431 | A | 12/1975 | Koh et al. |
| 3,958,957 | A | 5/1976 | Koh et al. |
| 3,966,875 | A | 6/1976 | Bratzler et al. |
| 3,969,089 | A | 7/1976 | Moss et al. |
| 3,972,693 | A | 8/1976 | Wiesner et al. |
| 3,975,168 | A | 8/1976 | Gorbaty |
| 3,985,519 | A | 10/1976 | Kalina et al. |
| 3,989,811 | A | 11/1976 | Hill |
| 3,996,014 | A | 12/1976 | Muller et al. |
| 3,998,607 | A | 12/1976 | Wesselhoft et al. |
| 3,999,607 | A | 12/1976 | Pennington et al. |
| 4,005,996 | A | 2/1977 | Hausberger et al. |
| 4,011,066 | A | 3/1977 | Bratzler et al. |
| 4,021,370 | A | 5/1977 | Harris et al. |
| 4,025,423 | A | 5/1977 | Stonner et al. |
| 4,044,098 | A | 8/1977 | Miller et al. |
| 4,046,523 | A | 9/1977 | Kalina et al. |
| 4,052,176 | A | 10/1977 | Child et al. |
| 4,053,554 | A | 10/1977 | Reed et al. |
| 4,057,512 | A | 11/1977 | Vadovic et al. |
| 4,069,304 | A | 1/1978 | Starkovich et al. |
| 4,077,778 | A | 3/1978 | Nahas et al. |
| 4,091,073 | A | 5/1978 | Winkler |
| 4,092,125 | A | 5/1978 | Stambaugh et al. |
| 4,094,650 | A | 6/1978 | Koh et al. |
| 4,100,256 | A | 7/1978 | Bozzelli et al. |
| 4,101,449 | A | 7/1978 | Noda et al. |
| 4,104,201 | A | 8/1978 | Banks et al. |
| 4,113,615 | A | 9/1978 | Gorbaty |
| 4,118,204 | A | 10/1978 | Eakman et al. |
| 4,152,119 | A | 5/1979 | Schulz |
| 4,157,246 | A | 6/1979 | Eakman et al. |
| 4,159,195 | A | 6/1979 | Clavenna |
| 4,162,902 | A | 7/1979 | Wiesner et al. |
| 4,189,307 | A | 2/1980 | Marion |
| 4,193,771 | A | 3/1980 | Sharp et al. |
| 4,193,772 | A | 3/1980 | Sharp |
| 4,200,439 | A | 4/1980 | Lang |
| 4,204,843 | A | 5/1980 | Neavel |
| 4,211,538 | A | 7/1980 | Eakman et al. |
| 4,211,669 | A | 7/1980 | Eakman et al. |
| 4,219,338 | A | 8/1980 | Wolfs et al. |
| 4,225,457 | A | 9/1980 | Schulz |
| 4,235,044 | A | 11/1980 | Cheung |
| 4,243,639 | A | 1/1981 | Haas et al. |
| 4,249,471 | A | 2/1981 | Gunnerman |
| 4,252,771 | A | 2/1981 | Lagana et al. |
| 4,260,421 | A | 4/1981 | Brown et al. |
| 4,265,868 | A | 5/1981 | Kamody |
| 4,270,937 | A | 6/1981 | Adler et al. |
| 4,284,416 | A | 8/1981 | Nahas |
| 4,292,048 | A | 9/1981 | Wesselhoft et al. |
| 4,298,584 | A | 11/1981 | Makrides |
| 4,315,758 | A | 2/1982 | Patel et al. |
| 4,318,712 | A | 3/1982 | Lang et al. |
| 4,322,222 | A | 3/1982 | Sass |
| 4,330,305 | A | 5/1982 | Kuessner et al. |
| 4,331,451 | A | 5/1982 | Isogaya et al. |
| 4,334,893 | A | 6/1982 | Lang |
| 4,336,034 | A | 6/1982 | Lang et al. |
| 4,336,233 | A | 6/1982 | Appl et al. |
| 4,344,486 | A | 8/1982 | Parrish |
| 4,347,063 | A | 8/1982 | Sherwood et al. |
| 4,348,486 | A | 9/1982 | Calvin et al. |
| 4,348,487 | A | 9/1982 | Calvin et al. |
| 4,353,713 | A | 10/1982 | Cheng |
| 4,365,975 | A | 12/1982 | Williams et al. |
| 4,372,755 | A | 2/1983 | Tolman et al. |
| 4,375,362 | A | 3/1983 | Moss |
| 4,397,656 | A | 8/1983 | Ketkar |
| 4,400,182 | A | 8/1983 | Davies et al. |
| 4,407,206 | A | 10/1983 | Bartok et al. |
| 4,428,535 | A | 1/1984 | Venetucci |
| 4,432,773 | A | 2/1984 | Euker, Jr. et al. |
| 4,433,065 | A | 2/1984 | Van Der Burgt et al. |
| 4,436,028 | A | 3/1984 | Wilder |
| 4,436,531 | A | 3/1984 | Estabrook et al. |
| 4,439,210 | A | 3/1984 | Lancet |
| 4,444,568 | A | 4/1984 | Beisswenger et al. |
| 4,459,138 | A | 7/1984 | Soung |
| 4,462,814 | A | 7/1984 | Holmes et al. |
| 4,466,828 | A | 8/1984 | Tamai et al. |
| 4,468,231 | A | 8/1984 | Bartok et al. |
| 4,478,725 | A | 10/1984 | Velling et al. |
| 4,482,529 | A | 11/1984 | Chen et al. |
| 4,491,609 | A | 1/1985 | Degel et al. |
| 4,497,784 | A | 2/1985 | Diaz |
| 4,500,323 | A | 2/1985 | Siegfried et al. |
| 4,505,881 | A | 3/1985 | Diaz |
| 4,508,544 | A | 4/1985 | Moss |
| 4,508,693 | A | 4/1985 | Diaz |
| 4,515,604 | A | 5/1985 | Eisenlohr et al. |
| 4,515,764 | A | 5/1985 | Diaz |
| 4,524,050 | A | 6/1985 | Chen et al. |
| 4,540,681 | A | 9/1985 | Kustes et al. |
| 4,541,841 | A | 9/1985 | Reinhardt |
| 4,551,155 | A | 11/1985 | Wood et al. |
| 4,558,027 | A | 12/1985 | McKee et al. |
| 4,572,826 | A | 2/1986 | Moore |
| 4,594,140 | A * | 6/1986 | Cheng ..... 208/414 |
| 4,597,775 | A | 7/1986 | Billimoria et al. |
| 4,597,776 | A | 7/1986 | Ullman et al. |
| 4,604,105 | A | 8/1986 | Aquino et al. |
| 4,609,388 | A | 9/1986 | Adler et al. |
| 4,609,456 | A | 9/1986 | Deschamps et al. |
| 4,617,027 | A | 10/1986 | Lang |
| 4,619,864 | A | 10/1986 | Hendrix et al. |
| 4,620,421 | A | 11/1986 | Brown et al. |
| 4,661,237 | A | 4/1987 | Kimura et al. |
| 4,668,428 | A | 5/1987 | Najjar |
| 4,668,429 | A | 5/1987 | Najjar |
| 4,675,035 | A | 6/1987 | Apffel |
| 4,678,480 | A | 7/1987 | Heinrich et al. |
| 4,682,986 | A | 7/1987 | Lee et al. |
| 4,690,814 | A | 9/1987 | Velenyi et al. |
| 4,704,136 | A | 11/1987 | Weston et al. |
| 4,720,289 | A | 1/1988 | Vaugh et al. |
| 4,747,938 | A | 5/1988 | Khan |
| 4,781,731 | A | 11/1988 | Schlinger |
| 4,803,061 | A | 2/1989 | Najjar et al. |
| 4,808,194 | A | 2/1989 | Najjar et al. |
| 4,810,475 | A | 3/1989 | Chu et al. |
| 4,822,935 | A | 4/1989 | Scott |
| 4,848,983 | A | 7/1989 | Tomita et al. |
| 4,854,944 | A | 8/1989 | Strong |
| 4,861,346 | A | 8/1989 | Najjar et al. |
| 4,861,360 | A | 8/1989 | Apffel |
| 4,872,886 | A | 10/1989 | Henley et al. |
| 4,876,080 | A | 10/1989 | Paulson |
| 4,892,567 | A | 1/1990 | Yan |
| 4,960,450 | A | 10/1990 | Schwarz et al. |
| 4,995,193 | A | 2/1991 | Soga et al. |
| 5,017,282 | A | 5/1991 | Delbianco et al. |
| 5,055,181 | A | 10/1991 | Maa et al. |
| 5,057,294 | A | 10/1991 | Sheth et al. |
| 5,059,406 | A | 10/1991 | Sheth et al. |
| 5,093,094 | A | 3/1992 | Van Kleeck et al. |
| 5,094,737 | A | 3/1992 | Bearden, Jr. et al. |
| 5,132,007 | A | 7/1992 | Meyer et al. |
| 5,223,173 | A | 6/1993 | Jeffrey |
| 5,236,557 | A | 8/1993 | Muller et al. |
| 5,250,083 | A | 10/1993 | Wolfenbarger et al. |
| 5,277,884 | A | 1/1994 | Shinnar et al. |
| 5,435,940 | A | 7/1995 | Doering et al. |
| 5,536,893 | A | 7/1996 | Gudmundsson |
| 5,616,154 | A | 4/1997 | Elliott et al. |
| 5,630,854 | A | 5/1997 | Sealock, Jr. et al. |
| 5,641,327 | A | 6/1997 | Leas |

| | | | |
|---|---|---|---|
| 5,660,807 | A | 8/1997 | Forg et al. |
| 5,670,122 | A | 9/1997 | Zamansky et al. |
| 5,720,785 | A | 2/1998 | Baker |
| 5,733,515 | A | 3/1998 | Doughty et al. |
| 5,776,212 | A | 7/1998 | Leas |
| 5,788,724 | A | 8/1998 | Carugati et al. |
| 5,855,631 | A | 1/1999 | Leas |
| 5,865,898 | A | 2/1999 | Holtzapple et al. |
| 5,968,465 | A | 10/1999 | Koveal et al. |
| 6,013,158 | A | 1/2000 | Wootten |
| 6,015,104 | A | 1/2000 | Rich, Jr. |
| 6,028,234 | A | 2/2000 | Heinemann et al. |
| 6,090,356 | A | 7/2000 | Jahnke et al. |
| 6,132,478 | A | 10/2000 | Tsurui et al. |
| 6,180,843 | B1 | 1/2001 | Heinemann et al. |
| 6,187,465 | B1 | 2/2001 | Galloway |
| 6,379,645 | B1 | 4/2002 | Bucci et al. |
| 6,389,820 | B1 | 5/2002 | Rogers et al. |
| 6,506,349 | B1 | 1/2003 | Khanmamedov |
| 6,506,361 | B1 | 1/2003 | Machado et al. |
| 6,602,326 | B2 | 8/2003 | Lee et al. |
| 6,641,625 | B1 | 11/2003 | Clawson et al. |
| 6,653,516 | B1 | 11/2003 | Yoshikawa et al. |
| 6,692,711 | B1 | 2/2004 | Alexion et al. |
| 6,790,430 | B1 | 9/2004 | Lackner et al. |
| 6,797,253 | B2 | 9/2004 | Lyon |
| 6,808,543 | B2 | 10/2004 | Paisley |
| 6,855,852 | B1 | 2/2005 | Jackson et al. |
| 6,878,358 | B2 | 4/2005 | Vosteen et al. |
| 6,894,183 | B2 | 5/2005 | Choudhary et al. |
| 6,955,695 | B2 | 10/2005 | Nahas |
| 6,969,494 | B2 | 11/2005 | Herbst |
| 7,074,373 | B1 | 7/2006 | Warren et al. |
| 7,132,183 | B2 | 11/2006 | Galloway |
| 7,205,448 | B2 | 4/2007 | Gajda et al. |
| 7,220,502 | B2 | 5/2007 | Galloway |
| 7,309,383 | B2 | 12/2007 | Beech, Jr. et al. |
| 7,897,126 | B2 | 3/2011 | Rappas et al. |
| 7,901,644 | B2 | 3/2011 | Rappas et al. |
| 7,922,782 | B2 | 4/2011 | Sheth |
| 7,926,750 | B2 | 4/2011 | Hauserman |
| 7,976,593 | B2 | 7/2011 | Graham |
| 2002/0036086 | A1 | 3/2002 | Minkkinen et al. |
| 2003/0131582 | A1 | 7/2003 | Anderson et al. |
| 2003/0167691 | A1 | 9/2003 | Nahas |
| 2004/0020123 | A1 | 2/2004 | Kimura et al. |
| 2004/0180971 | A1 | 9/2004 | Inoue et al. |
| 2005/0107648 | A1 | 5/2005 | Kimura et al. |
| 2005/0137442 | A1 | 6/2005 | Gajda et al. |
| 2005/0287056 | A1 | 12/2005 | Baker et al. |
| 2006/0265953 | A1 | 11/2006 | Hobbs |
| 2007/0000177 | A1 | 1/2007 | Hippo et al. |
| 2007/0051043 | A1 | 3/2007 | Schingnitz |
| 2007/0083072 | A1 | 4/2007 | Nahas |
| 2007/0180990 | A1 | 8/2007 | Downs et al. |
| 2007/0186472 | A1 | 8/2007 | Rabovitser et al. |
| 2007/0237696 | A1 | 10/2007 | Payton |
| 2007/0277437 | A1 | 12/2007 | Sheth |
| 2007/0282018 | A1 | 12/2007 | Jenkins et al. |
| 2009/0048476 | A1 | 2/2009 | Rappas et al. |
| 2009/0090055 | A1 | 4/2009 | Ohtsuka |
| 2009/0090056 | A1 | 4/2009 | Ohtsuka |
| 2009/0165361 | A1 | 7/2009 | Rappas et al. |
| 2009/0165376 | A1 | 7/2009 | Lau et al. |
| 2009/0165379 | A1 | 7/2009 | Rappas |
| 2009/0165380 | A1 | 7/2009 | Lau et al. |
| 2009/0165381 | A1 | 7/2009 | Robinson |
| 2009/0165382 | A1 | 7/2009 | Rappas et al. |
| 2009/0165383 | A1 | 7/2009 | Rappas et al. |
| 2009/0165384 | A1 | 7/2009 | Lau et al. |
| 2009/0166588 | A1 | 7/2009 | Spitz et al. |
| 2009/0169448 | A1 | 7/2009 | Rappas et al. |
| 2009/0169449 | A1 | 7/2009 | Rappas et al. |
| 2009/0170968 | A1 | 7/2009 | Nahas et al. |
| 2009/0173079 | A1 | 7/2009 | Wallace et al. |
| 2009/0217575 | A1 | 9/2009 | Raman et al. |
| 2009/0217582 | A1 | 9/2009 | May et al. |
| 2009/0217584 | A1 | 9/2009 | Raman et al. |
| 2009/0217585 | A1 | 9/2009 | Raman et al. |
| 2009/0217586 | A1 | 9/2009 | Rappas et al. |
| 2009/0217587 | A1 | 9/2009 | Raman et al. |
| 2009/0217588 | A1 | 9/2009 | Hippo et al. |
| 2009/0217589 | A1 | 9/2009 | Robinson |
| 2009/0217590 | A1 | 9/2009 | Rappas et al. |
| 2009/0218424 | A1 | 9/2009 | Hauserman |
| 2009/0220406 | A1 | 9/2009 | Rahman |
| 2009/0229182 | A1 | 9/2009 | Raman et al. |
| 2009/0246120 | A1 | 10/2009 | Raman et al. |
| 2009/0259080 | A1 | 10/2009 | Raman et al. |
| 2009/0260287 | A1 | 10/2009 | Lau |
| 2009/0324458 | A1 | 12/2009 | Robinson et al. |
| 2009/0324459 | A1 | 12/2009 | Robinson et al. |
| 2009/0324460 | A1 | 12/2009 | Robinson et al. |
| 2009/0324461 | A1 | 12/2009 | Robinson et al. |
| 2009/0324462 | A1 | 12/2009 | Robinson et al. |
| 2010/0071235 | A1 | 3/2010 | Pan et al. |
| 2010/0071262 | A1 | 3/2010 | Robinson et al. |
| 2010/0076235 | A1 | 3/2010 | Reiling et al. |
| 2010/0120926 | A1 | 5/2010 | Robinson et al. |
| 2010/0121125 | A1 | 5/2010 | Hippo et al. |
| 2010/0168494 | A1 | 7/2010 | Rappas et al. |
| 2010/0168495 | A1 | 7/2010 | Rappas et al. |
| 2010/0179232 | A1 | 7/2010 | Robinson et al. |
| 2010/0287835 | A1 | 11/2010 | Reiling et al. |
| 2010/0287836 | A1 | 11/2010 | Robinson et al. |
| 2010/0292350 | A1 | 11/2010 | Robinson et al. |
| 2011/0031439 | A1 | 2/2011 | Sirdeshpande et al. |
| 2011/0062012 | A1 | 3/2011 | Robinson |
| 2011/0062721 | A1 | 3/2011 | Sirdeshpande et al. |
| 2011/0062722 | A1 | 3/2011 | Sirdeshpande et al. |
| 2011/0064648 | A1 | 3/2011 | Preston et al. |
| 2011/0088896 | A1 | 4/2011 | Preston |
| 2011/0088897 | A1 | 4/2011 | Raman |
| 2011/0146978 | A1 | 6/2011 | Perlman |
| 2011/0146979 | A1 | 6/2011 | Wallace |

FOREIGN PATENT DOCUMENTS

| | | |
|---|---|---|
| CA | 1003217 | 1/1977 |
| CA | 1106178 | 8/1981 |
| CA | 1 125 026 | 6/1982 |
| CA | 1187702 | 6/1985 |
| CN | 1477090 | 2/2004 |
| DE | 2 210 891 | 3/1972 |
| DE | 2210891 | 9/1972 |
| DE | 2852710 | 6/1980 |
| DE | 3422202 | 12/1985 |
| DE | 100610607 | 6/2002 |
| EA | 819 | 4/2000 |
| EP | 0024792 | 3/1981 |
| EP | 0 067 580 | 12/1982 |
| EP | 102828 | 3/1984 |
| EP | 0 138 463 | 4/1985 |
| EP | 0 225 146 | 6/1987 |
| EP | 0 259 927 | 3/1988 |
| EP | 0 723 930 | 7/1996 |
| EP | 1 001 002 | 5/2000 |
| EP | 1 207 132 | 5/2002 |
| EP | 1 741 673 | 6/2006 |
| EP | 2058471 | 5/2009 |
| FR | 797 089 | 4/1936 |
| FR | 2 478 615 | 9/1981 |
| FR | 2906879 | 4/2008 |
| GB | 593910 | 10/1947 |
| GB | 640907 | 8/1950 |
| GB | 676615 | 7/1952 |
| GB | 701 131 | 12/1953 |
| GB | 760627 | 11/1956 |
| GB | 798741 | 7/1958 |
| GB | 820 257 | 9/1959 |
| GB | 996327 | 6/1965 |
| GB | 1033764 | 6/1966 |
| GB | 1448562 | 9/1976 |
| GB | 1453081 | 10/1976 |
| GB | 1467219 | 3/1977 |
| GB | 1467995 | 3/1977 |
| GB | 1 599 932 | 7/1977 |
| GB | 2078251 | 1/1982 |
| GB | 2154600 | 9/1985 |

| | | |
|---|---|---|
| GB | 2455864 | 6/2009 |
| JP | 54020003 | 2/1979 |
| JP | 56157493 | 12/1981 |
| JP | 62241991 | 10/1987 |
| JP | 62 257985 | 11/1987 |
| JP | 2000290659 | 10/2000 |
| JP | 2000290670 | 10/2000 |
| JP | 2002105467 | 4/2002 |
| JP | 2004292200 | 10/2004 |
| JP | 2004298818 | 10/2004 |
| JP | 2006 169476 A | 6/2006 |
| WO | 2000/18681 | 4/2000 |
| WO | WO 00/43468 | 7/2000 |
| WO | WO 02/40768 | 5/2002 |
| WO | WO 02/079355 | 10/2002 |
| WO | 2002/103157 | 12/2002 |
| WO | 2003/018958 | 3/2003 |
| WO | WO 03/033624 | 4/2003 |
| WO | 2004/055323 | 7/2004 |
| WO | WO 2004/072210 | 8/2004 |
| WO | WO 2006/031011 | 3/2006 |
| WO | WO 2007/005284 | 1/2007 |
| WO | WO 2007/047210 | 4/2007 |
| WO | 2007/068682 | 6/2007 |
| WO | 2007/077137 | 7/2007 |
| WO | 2007/077138 | 7/2007 |
| WO | 2007/083072 | 7/2007 |
| WO | WO 2007/076363 | 7/2007 |
| WO | WO 2007/128370 | 11/2007 |
| WO | 2007/143376 | 12/2007 |
| WO | WO 2007/143376 | 12/2007 |
| WO | 2008/058636 | 5/2008 |
| WO | WO 2008/073889 | 6/2008 |
| WO | 2008/087154 | 7/2008 |
| WO | 2009/018053 | 2/2009 |
| WO | WO 2009/018053 | 2/2009 |
| WO | WO 2009/048723 | 4/2009 |
| WO | WO 2009/048724 | 4/2009 |
| WO | WO 2009/086361 | 7/2009 |
| WO | WO 2009/086362 | 7/2009 |
| WO | WO 2009/086366 | 7/2009 |
| WO | WO 2009/086367 | 7/2009 |
| WO | WO 2009/086370 | 7/2009 |
| WO | WO 2009/086372 | 7/2009 |
| WO | WO 2009/086374 | 7/2009 |
| WO | WO 2009/086377 | 7/2009 |
| WO | WO 2009/086383 | 7/2009 |
| WO | WO 2009/086407 | 7/2009 |
| WO | WO 2009/086408 | 7/2009 |
| WO | WO 2009/111330 | 9/2009 |
| WO | WO 2009/111331 | 9/2009 |
| WO | WO 2009/111332 | 9/2009 |
| WO | WO 2009/111335 | 9/2009 |
| WO | WO 2009/111342 | 9/2009 |
| WO | WO 2009/111345 | 9/2009 |
| WO | WO 2009/124017 | 10/2009 |
| WO | WO 2009/124019 | 10/2009 |
| WO | WO 2009/158576 | 12/2009 |
| WO | WO 2009/158579 | 12/2009 |
| WO | WO 2009/158580 | 12/2009 |
| WO | WO 2009/158582 | 12/2009 |
| WO | WO 2009/158583 | 12/2009 |
| WO | WO 2010/033846 | 3/2010 |
| WO | WO 2010/033848 | 3/2010 |
| WO | WO 2010/033850 | 3/2010 |
| WO | WO 2010/033852 | 3/2010 |
| WO | WO 2010/048493 | 4/2010 |
| WO | WO 2010/078297 | 7/2010 |
| WO | WO 2010/078298 | 7/2010 |
| WO | 2011/029278 | 3/2011 |
| WO | 2011/029282 | 3/2011 |
| WO | 2011/029283 | 3/2011 |
| WO | 2011/029284 | 3/2011 |
| WO | 2011/029285 | 3/2011 |
| WO | 2011/063608 | 6/2011 |

OTHER PUBLICATIONS

U.S. Appl. No. 12/778,548, filed May 12, 2010, Robinson, et al.
U.S. Appl. No. 12/778,552, filed May 12, 2010, Robinson, et al.
Adsorption, http://en.wikipedia.org/wiki/Adsorption, pp. 1-8.
Amine gas treating, http://en.wikipedia.org/wiki/Acid_gas_removal, pp. 1-4.
Coal, http://en.wikipedia.org/wiki/Coal_gasification, pp. 1-8.
Coal Data: A Reference, Energy Information Administration, Office of Coal, Nuclear, Electric, and Alternate Fuels U.S. Department of Energy, DOE/EIA-0064(93), Feb. 1995.
Deepak Tandon, Dissertation Approval, "Low Temperature and Elevated Pressure Steam Gasification of Illinois Coal", Jun. 13, 1996.
Demibras, "Demineralization of Agricultural Residues by Water Leaching", *Energy Sources*, vol. 25, pp. 679-687, (2003).
Fluidized Bed Gasifiers, http://www.energyproducts.com/fluidized_bed_gasifiers.htm, pp. 1-5.
Gas separation, http://en.wikipedia.org/wiki/Gas_separation, pp. 1-2.
Gasification, http://en.wikipedia.org/wiki/Gasification, pp. 1-6.
Gallagher Jr., et al., "Catalytic Coal Gasification for SNG Manufacture", *Energy Research*, vol. 4, pp. 137-147, (1980).
Heinemann, et al., "Fundamental and Exploratory Studies of Catalytic Steam Gasification of Carbonaceous Materials", Final Report Fiscal Years 1985-1994.
Jensen, et al. Removal of K and C1 by leaching of straw char, *Biomass and Bioenergy*, vol. 20, pp. 447-457, (2001).
Mengjie, et al., "A potential renewable energy resource development and utilization of biomass energy", http://www.fao.org.docrep/T4470E/T4470e0n.htm, pp. 1-8.
Meyers, et al. Fly Ash as a Construction Material for Highways, A Manual. Federal Highway Administration, Report No. FHWA-IP-76-16, Washington, DC, 1976.
Moulton, Lyle K. "Bottom Ash and Boiler Slag", *Proceedings of the Third International Ash Utilization Symposium*, U.S. Bureau of Mines, Information Circular No. 8640, Washington, DC, 1973.
Natural gas processing, http://en.wikipedia.org/wiki/Natural_gas_processing, pp. 1-4.
Natural Gas Processing: The Crucial Link Between Natural Gas Production and Its Transportation to Market. Energy Information Administration, Office of Oil and Gas; pp. 1-11, (2006).
Prins, et al., "Exergetic optimisation of a production process of Fischer-Tropsch fuels from biomass", *Fuel Processing Technology*, vol. 86, pp. 375-389, (2004).
Reboiler, http://en.wikipedia.org/wiki/Reboiler, pp. 1-4.
What is XPS?, http://www.nuance.northwestern.edu/Keckll/xps1.asp, pp. 1-2.
2.3 Types of gasifiers, http://www.fao.org/docrep/t0512e0a.htm, pp. 1-6.
2.4 Gasification fuels, http://www.fao.org/docrep/t0512e/T0512e0b.htm#TopofPage, pp. 1-8.
2.5 Design of downdraught gasifiers, http://www.fao.org/docrep/t0512e/t0512e0c.htm#TopOfPage, pp. 1-8.
2.6 Gas cleaning and cooling, http://www.fao.org/docrep/t0512e0d.htm#TopOFPage, pp. 1-3.
Asami, K., et al., "Highly Active Iron Catalysts from Ferric Chloride or the Steam Gasification of Brown Coal," ind. Eng. Chem. Res., vol. 32, No. 8, 1993, pp. 1631-1636.
Berger, R., et al., "High Temperature $CO_2$-Absorption: A Process Offering New Prospects in Fuel Chemistry," The Fifth International Symposium on Coal Combustion, Nov. 2003, Nanjing, China, pp. 547-549.
Brown et al., "Biomass-Derived Hydrogen From a Thermally Ballasted Gasifier," Aug. 2005.
Brown et al., "Biomass-Derived Hydrogen From a Thermally Ballasted Gasifier," DOE Hydrogen Program Contractors' Review Metting, Center for Sustainable Environmental Technologies, Iowa State University, May 21, 2003.
Coal Conversion Processes (Gasification), Encyclopedia of Chemical Technology, $4^{th}$ Edition, vol. 6, pp. 541-566.
Cohen, S.J., Project Manager, "Large Pilot Plant Alternatives for Scaleup of the Catalytic Coal Gasification Process," FE-2480-20, U.S. Dept. of Energy, Contract No. EX-76-C-01-2480, 1979.
Euker, Jr., C.A., Reitz, R.A., Program Managers, "Exxon Catalytic Coal-Gasification-Process Development Program," Exxon Research & Engineering Company, FE-2777-31, U.S. Dept. of Energy, Contract No. ET-78-C-01-2777, 1981.

Kalina, T., Nahas, N.C., Project Managers, "Exxon Catalaytic Coal Gasification Process Predevelopment Program," Exxon Research & Engineering Company, FE-2369-24, U.S. Dept. of Energy, Contract No. E(49-18)-2369, 1978.
Nahas, N.C., "Exxon Catalytic Coal Gasification Process—Fundamentals to Flowsheets," Fuel, vol. 62, No. 2, 1983, pp. 239-241.
Ohtsuka, Y. et al., "Highly Active Catalysts from Inexpensive Raw Materials for Coal Gasification," Catalysis Today, vol. 39, 1997, pp. 111-125.
Ohtsuka, Yasuo et al, "Steam Gasification of Low-Rank Coals with a Chlorine-Free Iron Catalyst from Ferric Chloride," Ind. Eng. Chem. Res., vol. 30, No. 8, 1991, pp. 1921-1926.
Ohtsuka, Yasuo et al., "Calcium Catalysed Steam Gasification of Yalourn Brown Coal," Fuel, vol. 65, 1986, pp. 1653-1657.
Ohtsuka, Yasuo, et al, "Iron-Catalyzed Gasification of Brown Coal at Low Temperatures," Energy & Fuels, vol. 1, No. 1, 1987, pp. 32-36.
Ohtsuka, Yasuo, et al., "Ion-Exchanged Calcium From Calcium Carbonate and Low-Rank Coals: High Catalytic Activity in Steam Gasification," Energy & Fuels 1996, 10, pp. 431-435.
Ohtsuka, Yasuo et al., "Steam Gasification of Coals with Calcium Hydroxide," Energy & Fuels, vol. 9, No. 6, 1995, pp. 1038-1042.
Pereira, P., et al., "Catalytic Steam Gasification of Coals," Energy & Fuels, vol. 6, No. 4, 1992, pp. 407-410.
Ruan Xiang-Quan, et al., "Effects of Catalysis on Gasification of Tatong Coal Char," Fuel, vol. 66, Apr. 1987, pp. 568-571.
Tandon, D., "Low Temperature and Elevated Pressure Steam Gasification of Illinois Coal," College of Engineering in the Graduate School, Southern Illinois university at Carbondale, Jun. 1996.
"Integrate Gasification Combined Cycle (IGCC)," WorleyParsons Resources & Energy, http://www.worleyparsons.com/v5/page.aspx?id=164.
A.G. Collot et al., "Co-pyrolysis and co-gasification of coal and biomass in bench-scale fixed-bed and fluidized bed reactors", (1999) Fuel 78, pp. 667-679.
Wenkui Zhu et al., "Catalytic gasification of char from co-pyrolysis of coal and biomass", (2008) Fuel Processing Technology, vol. 89, pp. 890-896.
Chiesa P. et al., "Co-Production of hydrogen, electricity and CO2 from coal with commercially ready technology. Part a: Performance and emissions", (2005) International Journal of Hydrogen Energy, vol. 30, No. 7, pp. 747-767.
Brown et al., "Biomass-Derived Hydrogen From a Thermally Ballasted Gasifier", DOE Hydrogen Program Contractors' Review meeting, May 18-21, 2003, Center for Sustainable Environmental Technologies Iowa State University.
Brown et al., "Biomass-Derived Hydrogen From a thermally Ballasted Gasifier", Final Technical Report, Iowa State University, Aug. 2005.
Chiaramonte et al, "Upgrade Coke by Gasification", (1982) Hydrocarbon Processing, vol. 61 (9), pp. 255-257 (Abstract only).

* cited by examiner

PROCESSES FOR MAKING SYNGAS-DERIVED PRODUCTS

CROSS-REFERENCE TO RELATED APPLICATIONS

This application claims priority under 35 U.S.C. §119 from U.S. Provisional Application Ser. No. 61/017,305 (filed Dec. 28, 2007), the disclosure of which is incorporated by reference herein for all purposes as if fully set forth.

This application is related to U.S. application Ser. No. 12/342,596, filed concurrently herewith, entitled "PROCESSES FOR MAKING SYNTHESIS GAS AND SYNGAS-DERIVED PRODUCTS".

FIELD OF THE INVENTION

The present invention relates to processes for making syngas-derived products.

BACKGROUND OF THE INVENTION

In view of numerous factors such as higher energy prices and environmental concerns, the production of value-added gaseous products from lower-fuel-value carbonaceous feedstocks, such as petroleum coke and coal, is receiving renewed attention. The catalytic gasification of such materials to produce methane and other value-added gases is disclosed, for example, in U.S. Pat. No. 3,828,474, U.S. Pat. No. 3,998,607, U.S. Pat. No. 4,057,512, U.S. Pat. No. 4,092,125, U.S. Pat. No. 4,094,650, U.S. Pat. No. 4,204,843, U.S. Pat. No. 4,468,231, U.S. Pat. No. 4,500,323, U.S. Pat. No. 4,541,841, U.S. Pat. No. 4,551,155, U.S. Pat. No. 4,558,027, U.S. Pat. No. 4,606,105, U.S. Pat. No. 4,617,027, U.S. Pat. No. 4,609,456, U.S. Pat. No. 5,017,282, U.S. Pat. No. 5,055,181, U.S. Pat. No. 6,187,465, U.S. Pat. No. 6,790,430, U.S. Pat. No. 6,894,183, U.S. Pat. No. 6,955,695, US2003/0167961A1, US2006/0265953A1, US2007/000177A1, US2007/083072A1, US2007/0277437A1 and GB1599932.

Synthesis gas (i.e., a gas mixture having predominant quantities of CO and $H_2$) is typically used as a feedstock for other processes, for example processes used to make lower alcohols and ethers as well as hydrocarbonaceous products such as Fischer-Tropsch diesel fuel and synthetic crude oil (syncrude). Synthesis gas can be formed from lower-fuel value feedstocks using, for example, gasification processes. For example, in one such process a carbonaceous feedstock is gasified non-catalytically by partial oxidation by a mixture of oxygen and steam; about a third of the feedstock is burned in the process to provide heat and pressure, making this process relatively energy-inefficient. In other such processes, catalytic gasification is followed by one or more cryogenic separations to separate the catalytic gasification product gas into methane and $CO/H_2$ fractions. These processes can be disadvantaged in that they are relatively energy-intensive. Accordingly, processes are needed which can more efficiently form syngas-derived products from lower-fuel-value carbonaceous feedstocks.

SUMMARY OF THE INVENTION

In one aspect, the present invention provides a process for making a syngas-derived product from a carbonaceous feedstock, the process comprising the steps of: (a) providing a carbonaceous feedstock; (b) converting the carbonaceous feedstock in a syngas formation zone at least in part to a synthesis gas stream comprising hydrogen and carbon monoxide; (c) conveying the synthesis gas stream to a syngas reaction zone; (d) reacting the synthesis gas stream in the syngas reaction zone to form the syngas-derived product and heat energy; (e) recovering the syngas-derived product; and (f) recovering the heat energy formed from the reaction of the synthesis gas stream.

In a second a aspect, the present invention provides a process for making a syngas-derived product from a carbonaceous feedstock, the process comprising the steps of: (a) providing a carbonaceous feedstock; (b) converting the carbonaceous feedstock in a syngas formation zone at least in part to a synthesis gas stream comprising hydrogen and carbon monoxide; (c) conveying the synthesis gas stream to a syngas reaction zone; (d) reacting the synthesis gas stream in the syngas reaction zone to form the syngas-derived product and a combustible tail gas mixture; (e) recovering the syngas-derived product; and (f) burning the combustible tail gas mixture to provide heat energy.

DETAILED DESCRIPTION

Figure 1:
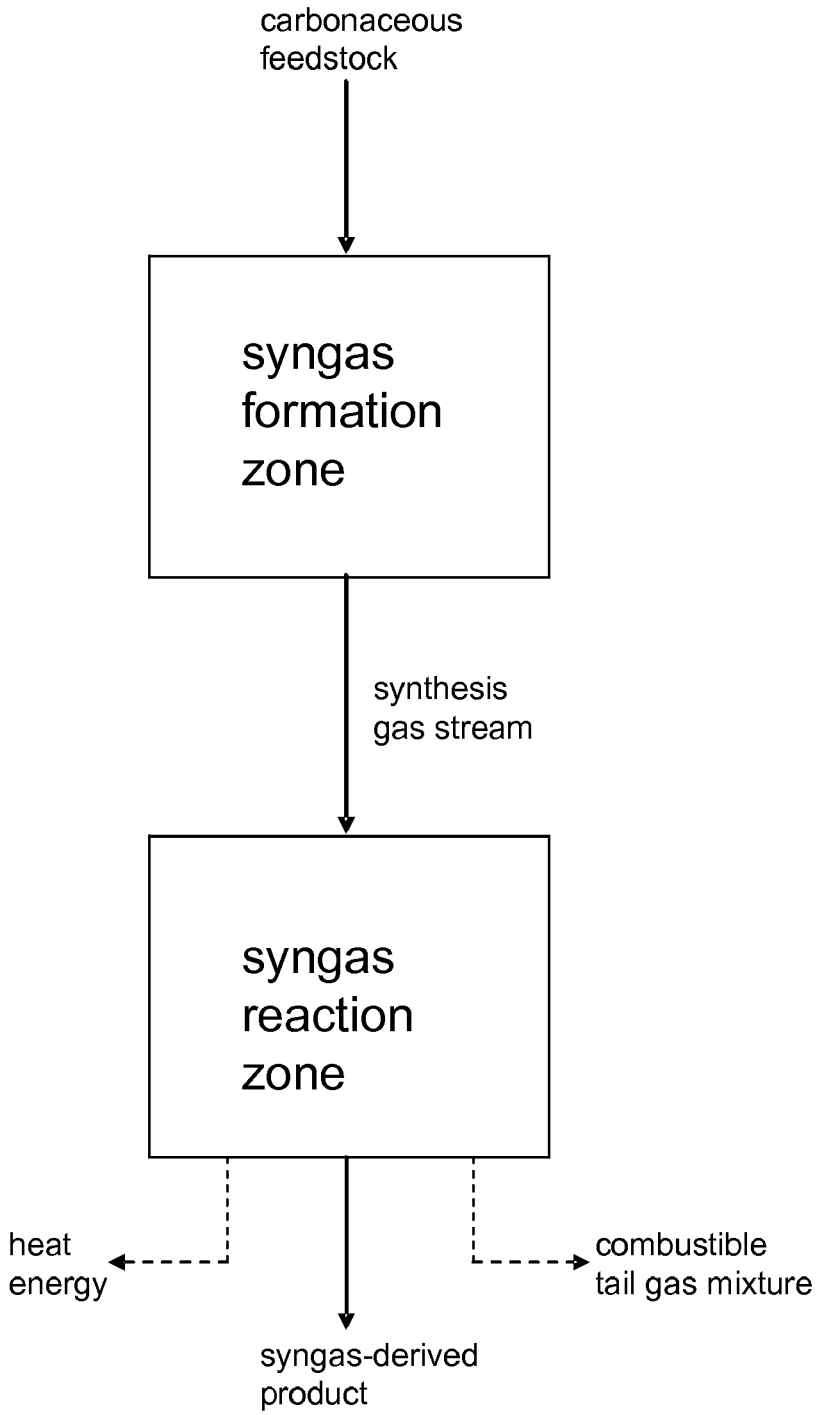
FIG. 1 is a schematic diagram of a process for making a syngas-derived product according to one embodiment of the invention.

The present invention relates generally to processes for making syngas-derived products. An example of a process according to one aspect of the invention is illustrated in flowchart form in FIG. 1. Generally, in one process for making synthesis gas according to the present invention, a carbonaceous feedstock is converted in a syngas formation zone at least in part to a synthesis gas stream comprising hydrogen and carbon monoxide. As described in more detail below, virtually any process can be used to convert the carbonaceous feedstock into the synthesis gas stream, including, for example, catalytic and non-catalytic gasification-based processes. The synthesis gas stream is conveyed to a syngas reaction zone, where it is reacted to form the syngas-derived product, which is recovered for further reaction, processing, or packaging. The reaction of the synthesis gas stream can also form heat energy, which is recovered; or a combustible tail gas mixture, which is burned to provide heat energy. The heat energy so produced can be used in a number of applications. For example, it can be used (e.g., through the generation or heating of steam) in the conversion of the carbonaceous feedstock. The heat energy can also be used to generate electrical power, e.g., through heating or generating steam and driving it through a turbine. In another embodiment of invention, the combustible tail gas is used as a supplementary fuel to fire reforming furnaces; this integration is particularly useful because the amount of combustible tail gas is proportional to the firing duty of the reforming furnaces. Accordingly, in this aspect of the invention, synthesis gas can be converted to a useful syngas-derived product, while the energy stored in the CO triple bond can be liberated, recovered and used, thereby increasing the overall energy efficiency of the process.

The present invention can be practiced, for example, using any of the developments to catalytic gasification technology disclosed in commonly owned US2007/0000177A1, US2007/0083072A1 and US2007/0277437A1; and U.S. patent application Ser. Nos. 12/178,380 (filed 23 Jul. 2008), 12/234,012 (filed 19 Sep. 2008) and 12/234,018 (filed 19 Sep. 2008). Moreover, the processes of the present invention can be practiced in conjunction with the subject matter of the following U.S. Patent Applications, each of which was filed on even date herewith: Ser. No. 12/342,565, entitled "PETROLEUM COKE COMPOSITIONS FOR CATALYTIC GASIFICATION"; Ser. No. 12/342,554, entitled "CATALYTIC GASIFICATION PROCESS WITH RECOVERY OF ALKALI METAL FROM CHAR"; Ser. No. 12/342,608, entitled "PETROLEUM COKE COMPOSITIONS FOR CATALYTIC GASIFICATION"; Ser. No. 12/342,663, entitled "CARBONACEOUS FUELS AND PROCESSES FOR MAKING AND USING THEM"; Ser. No. 12/342,715, entitled "CATALYTIC GASIFICATION PROCESS WITH RECOVERY OF ALKALI METAL FROM CHAR"; Ser. No. 12/342,578, entitled "COAL COMPOSITIONS FOR CATALYTIC GASIFICATION"; Ser. No. 12/342,596, entitled "PROCESSES FOR MAKING SYNTHESIS GAS AND SYNGAS-DERIVED PRODUCTS"; Ser. No. 12/342,736, entitled "CATALYTIC GASIFICATION PROCESS WITH RECOVERY OF ALKALI METAL FROM CHAR"; Ser. No. 12/343,143, entitled "CATALYTIC GASIFICATION PROCESS WITH RECOVERY OF ALKALI METAL FROM CHAR"; Ser. No. 12/343,159, entitled "CONTINUOUS PROCESSES FOR CONVERTING CARBONACEOUS FEEDSTOCK INTO GASEOUS PRODUCTS"; and Ser. No. 12/343,149, entitled "STEAM GENERATING SLURRY GASIFIER FOR THE CATALYTIC GASIFICATION OF A CARBONACEOUS FEEDSTOCK". All of the above are incorporated herein by reference for all purposes as if fully set forth.

All publications, patent applications, patents and other references mentioned herein, if not otherwise indicated, are explicitly incorporated by reference herein in their entirety for all purposes as if fully set forth.

Unless otherwise defined, all technical and scientific terms used herein have the same meaning as commonly understood by one of ordinary skill in the art to which this invention belongs. In case of conflict, the present specification, including definitions, will control.

Except where expressly noted, trademarks are shown in upper case.

Although methods and materials similar or equivalent to those described herein can be used in the practice or testing of the present invention, suitable methods and materials are described herein.

Unless stated otherwise, all percentages, parts, ratios, etc., are by weight.

When an amount, concentration, or other value or parameter is given as a range, or a list of upper and lower values, this is to be understood as specifically disclosing all ranges formed from any pair of any upper and lower range limits, regardless of whether ranges are separately disclosed. Where a range of numerical values is recited herein, unless otherwise stated, the range is intended to include the endpoints thereof, and all integers and fractions within the range. It is not intended that the scope of the present invention be limited to the specific values recited when defining a range.

When the term "about" is used in describing a value or an end-point of a range, the invention should be understood to include the specific value or end-point referred to.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but can include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The use of "a" or "an" to describe the various elements and components herein is merely for convenience and to give a general sense of the invention. This description should be read to include one or at least one and the singular also includes the plural unless it is obvious that it is meant otherwise.

The materials, methods, and examples herein are illustrative only and, except as specifically stated, are not intended to be limiting.

Carbonaceous Feedstock

The term "carbonaceous feedstock" as used herein refers to a carbonaceous material that is used as a feedstock in a catalytic gasification reaction. The carbonaceous feedstock can be formed, for example, from coal, petroleum coke, liquid petroleum residue, asphaltenes or mixtures thereof. The carbonaceous feedstock can come from a single source, or from two or more sources. For example, the carbonaceous feedstock can be formed from one or more tar sands petcoke materials, one or more coal materials, or a mixture of the two. In one embodiment of the invention, the carbonaceous feedstock is coal, petroleum coke, or a mixture thereof.

Petroleum Coke

The term "petroleum coke" as used herein includes both (i) the solid thermal decomposition product of high-boiling hydrocarbon fractions obtained in petroleum processing (heavy residues—"resid petcoke") and (ii) the solid thermal decomposition product of processing tar sands (bituminous sands or oil sands—"tar sands petcoke"). Such carbonization products include, for example, green, calcined, needle petroleum coke and fluidized bed petroleum coke.

Resid petcoke can be derived from a crude oil, for example, by coking processes used for upgrading heavy-gravity crude oil distillation residue, which petroleum coke contains ash as a minor component, typically about 1.0 wt % or less, and more typically about 0.5 wt % or less, based on the weight of the coke. Typically, the ash in such lower-ash cokes predominantly comprises metals such as nickel and vanadium.

Tar sands petcoke can be derived from an oil sand, for example, by coking processes used for upgrading oil sand. Tar sands petcoke contains ash as a minor component, typically in the range of about 2 wt % to about 12 wt %, and more typically in the range of about 4 wt % to about 12 wt %, based on the overall weight of the tar sands petcoke. Typically, the ash in such higher-ash cokes predominantly comprises materials such as compounds of silicon and/or aluminum.

The petroleum coke (either resid petcoke or tar sands petcoke) can comprise at least about 70 wt % carbon, at least about 80 wt % carbon, or at least about 90 wt % carbon, based on the total weight of the petroleum coke. Typically, the petroleum coke comprises less than about 20 wt % percent inorganic compounds, based on the weight of the petroleum coke.

Liquid Petroleum Residue

The term "liquid petroleum residue" as used herein includes both (i) the liquid thermal decomposition product of high-boiling hydrocarbon fractions obtained in petroleum processing (heavy residues—"resid liquid petroleum residue") and (ii) the liquid thermal decomposition product of processing tar sands (bituminous sands or oil sands—"tar sands liquid petroleum residue"). The liquid petroleum residue is substantially non-solid; for example, it can take the form of a thick fluid or a sludge.

Resid liquid petroleum residue can be derived from a crude oil, for example, by processes used for upgrading heavy-gravity crude oil distillation residue. Such liquid petroleum residue contains ash as a minor component, typically about 1.0 wt % or less, and more typically about 0.5 wt % of less, based on the weight of the residue. Typically, the ash in such lower-ash residues predominantly comprises metals such as nickel and vanadium.

Tar sands liquid petroleum residue can be derived from an oil sand, for example, by processes used for upgrading oil sand. Tar sands liquid petroleum residue contains ash as a minor component, typically in the range of about 2 wt % to about 12 wt %, and more typically in the range of about 4 wt % to about 12 wt %, based on the overall weight of the residue. Typically, the ash in such higher-ash residues predominantly comprises materials such as compounds of silicon and/or aluminum.

Asphaltenes

Asphaltenes typically comprise aromatic carbonaceous solids at room temperature, and can be derived, from example, from the processing of crude oil and crude oil tar sands.

Coal

The term "coal" as used herein means peat, lignite, sub-bituminous coal, bituminous coal, anthracite, or mixtures thereof. In certain embodiments, the coal has a carbon content of less than about 85%, or less than about 80%, or less than about 75%, or less than about 70%, or less than about 65%, or less than about 60%, or less than about 55%, or less than about 50% by weight, based on the total coal weight. In other embodiments, the coal has a carbon content ranging up to about 85%, or up to about 80%, or up to about 75% by weight, based on the total coal weight. Examples of useful coals include, but are not limited to, Illinois #6, Pittsburgh #8, Beulah (ND), Utah Blind Canyon, and Powder River Basin (PRB) coals. Anthracite, bituminous coal, sub-bituminous coal, and lignite coal may contain about 10 wt %, from about 5 to about 7 wt %, from about 4 to about 8 wt %, and from about 9 to about 11 wt %, ash by total weight of the coal on a dry basis, respectively. However, the ash content of any particular coal source will depend on the rank and source of the coal, as is familiar to those skilled in the art. See, for example, "Coal Data: A Reference", Energy Information Administration, Office of Coal, Nuclear, Electric and Alternate Fuels, U.S. Department of Energy, DOE/EIA-0064(93), February 1995.

Conversion of the Carbonaceous Feedstock to a Synthesis Gas Stream

In processes according to the present invention, the carbonaceous feedstock is converted to a synthesis gas stream in a syngas formation zone. The syngas formation zone is the area or collection of one or more apparatuses in which the carbonaceous feedstock is converted to the synthesis gas stream; it can include one or more reactors, pre-processing apparatuses, gas purification apparatuses, etc. As the person of skill in the art will appreciate, virtually any convenient processes and apparatuses can be used to perform the conversion. Specific examples of catalytic gasification processes and apparatuses are described in detail below; however, it should be understood that these are merely embodiments of the invention, and that the broader aspects of the invention are not limited thereby.

One example of a process suitable for use in the present invention is described in the above-referenced U.S. patent application Ser. No. 12/342,596, entitled "PROCESSES FOR MAKING SYNTHESIS GAS AND SYNGAS-DERIVED PRODUCTS". In this disclosure, a process for making a synthesis gas stream comprising hydrogen and carbon monoxide is described, in which the process comprises: (a) providing a carbonaceous feedstock; (b) reacting the carbonaceous feedstock in a gasification reactor in the presence of steam and a gasification catalyst under suitable temperature and pressure to form a raw product gas stream comprising a plurality of gases comprising methane, hydrogen and carbon monoxide; (c) removing steam from and sweetening the raw product gas stream to form a sweetened gas stream; (d) separating and adding steam to at least a first portion of the sweetened gas stream to form a first reformer input gas stream having a first steam/methane ratio; and a second reformer input stream having a second steam/methane ratio, in which the first steam/methane ratio is smaller than the second steam/methane ratio; (e) reforming the second reformer input stream to form a recycle gas stream comprising steam, carbon monoxide and hydrogen; (f) introducing the recycle gas stream to the gasification reactor; and (g) reforming the first reformer input stream to form the synthesis gas stream.

Catalytic Gasification Methods

The gasification processes referred to in the context of such disclosure include reacting a particulate carbonaceous feedstock in a gasifying reactor in the presence of steam and a gasification catalyst under suitable temperature and pressure to form a plurality of gaseous products comprising methane and at least one or more of hydrogen, carbon monoxide, carbon dioxide, hydrogen sulfide, ammonia and other higher hydrocarbons, and a solid char residue. Examples of such gasification processes are, disclosed, for example, in previously incorporated U.S. Pat. No. 3,828,474, U.S. Pat. No. 3,998,607, U.S. Pat. No. 4,057,512, U.S. Pat. No. 4,092,125, U.S. Pat. No. 4,094,650, U.S. Pat. No. 4,204,843, U.S. Pat. No. 4,468,231, U.S. Pat. No. 4,500,323, U.S. Pat. No. 4,541,841, U.S. Pat. No. 4,551,155, U.S. Pat. No. 4,558,027, U.S. Pat. No. 4,606,105, U.S. Pat. No. 4,617,027, U.S. Pat. No. 4,609,456, U.S. Pat. No. 5,017,282, U.S. Pat. No. 5,055,181, U.S. Pat. No. 6,187,465, U.S. Pat. No. 6,790,430, U.S. Pat. No. 6,894,183, U.S. Pat. No. 6,955,695, US2003/0167961A1, US2006/0265953A1, US2007/000177A1, US2007/083072A1, US2007/0277437A1 and GB1599932; commonly owned U.S. patent application Ser. Nos. 12/178,380 (filed 23 Jul. 2008), 12/234,012 (filed 19 Sep. 2008) and 12/234,018 (filed 19 Sep. 2008); as well as in previously incorporated U.S. patent application Ser. No. 12/343,159, entitled "CONTINUOUS PROCESSES FOR CONVERTING CARBONACEOUS FEEDSTOCK INTO GASEOUS PRODUCTS"; Ser. No. 12/342,715, entitled "CATALYTIC GASIFICATION PROCESS WITH RECOVERY OF ALKALI METAL FROM CHAR"; Ser. No. 12/342,596, entitled "PROCESSES FOR MAKING SYNTHESIS GAS AND SYNGAS-DERIVED PRODUCTS"; Ser. No. 12/342,736, entitled "CATALYTIC GASIFICATION PROCESS WITH RECOVERY OF ALKALI METAL FROM CHAR"; Ser. No. 12/343,143, entitled "CATALYTIC GASIFICATION PROCESS WITH RECOVERY OF ALKALI METAL FROM CHAR"; Ser. No. 12/343,149, entitled "STEAM GENERATING SLURRY GASIFIER FOR THE CATALYTIC GASIFICATION OF A CARBONACEOUS FEEDSTOCK"; and Ser. No. 12/342,663, entitled "CARBONACEOUS FUELS AND PROCESSES FOR MAKING AND USING THEM".

The gasification reactors for such processes are typically operated at moderately high pressures and temperatures, requiring introduction of the particulate carbonaceous feedstock to the reaction zone of the gasification reactor while maintaining the required temperature, pressure, and flow rate of the particulate carbonaceous feedstock. Those skilled in the art are familiar with feed systems for providing feedstocks to high pressure and/or temperature environments, including, star feeders, screw feeders, rotary pistons, and lock-hoppers for feeding solids, and centrifugal pumps and steam atomized spray nozzles for feeding liquids. It should be understood that the feed system can include two or more pressure-balanced elements, such as lock hoppers, which would be used alternately.

In some instances, the particulate carbonaceous feedstock can be prepared at pressure conditions above the operating pressure of the gasification reactor. Hence, the particulate carbonaceous feedstock can be directly passed into the gasification reactor without further pressurization.

Typically, the carbonaceous feedstock is supplied to the gasifying reactor as particulates having an average particle size of from about 250 microns, or from about 25 microns, up to about 500, or up to about 2500 microns. One skilled in the art can readily determine the appropriate particle size for the particulates. For example, when a fluid bed gasification reactor is used, the particulate carbonaceous feedstock can have an average particle size which enables incipient fluidization of the particulate petroleum coke feed material at the gas velocity used in the fluid bed gasification reactor. Processes for preparing particulates are described in more detail below.

Suitable gasification reactors include counter-current fixed bed, co-current fixed bed, fluidized bed, entrained flow, and moving bed reactors. The pressure in the gasification reactor typically will be about from about 10 to about 100 atm (from about 150 to about 1500 psig). The gasification reactor typically will be operated at moderate temperatures of at least about 450° C., or of at least about 600° C. or above, to about 900° C., or to about 750° C., or to about 700° C.; and at pressures of at least about 50 psig, or at least about 200 psig, or at least about 400 psig, to about 1000 psig, or to about 700 psig, or to about 600 psig.

The gas utilized in the gasification reactor for pressurization and reactions of the particulate carbonaceous feedstock typically comprises steam, and optionally oxygen, air, CO and/or $H_2$, and is supplied to the reactor according to methods known to those skilled in the art. Typically, the carbon monoxide and hydrogen produced in the gasification is recovered and recycled. In some embodiments, however, the gasification environment remains substantially free of air, particularly oxygen. In one embodiment of the invention, the reaction of the carbonaceous feedstock is carried out in an atmosphere having less than 1% oxygen by volume.

Any of the steam boilers known to those skilled in the art can supply steam to the gasification reactor. Such boilers can be fueled, for example, through the use of any carbonaceous material such as powdered coal, biomass etc., and including but not limited to rejected carbonaceous materials from the particulate carbonaceous feedstock preparation operation (e.g., fines, supra). Steam can also be supplied from a second gasification reactor coupled to a combustion turbine where the exhaust from the reactor is thermally exchanged to a water source to produce steam. Steam may also be generated from heat recovered from the hot raw gasifier product gas.

Recycled steam from other process operations can also be used for supplying steam to the gasification reactor. For example, when the slurried particulate carbonaceous feedstock is dried with a fluid bed slurry drier (as discussed below), the steam generated through vaporization can be fed to the gasification reactor.

The small amount of required heat input for the catalytic gasification reaction can be provided by superheating a gas mixture of steam and recycle gas feeding the gasification reactor by any method known to one skilled in the art. In one method, compressed recycle gas of CO and $H_2$ can be mixed with steam and the resulting steam/recycle gas mixture can be further superheated by heat exchange with the gasification reactor effluent followed by superheating in a recycle gas furnace.

A methane reformer can be included in the process to supplement the recycle CO and $H_2$ fed to the reactor to ensure that the reaction is run under thermally neutral (adiabatic) conditions. In such instances, methane can be supplied for the reformer from the methane product, as described below.

Reaction of the particulate carbonaceous feedstock under the described conditions typically provides a raw product gas comprising a plurality of gaseous products comprising methane and at least one or more of hydrogen, carbon monoxide and other higher hydrocarbons, and a solid char residue. The char residue produced in the gasification reactor during the present processes is typically removed from the gasification reactor for sampling, purging, and/or catalyst recovery. Methods for removing char residue are well known to those skilled in the art. One such method taught by EP-A-0102828, for example, can be employed. The char residue can be periodically withdrawn from the gasification reactor through a lock hopper system, although other methods are known to those skilled in the art.

The raw product gas stream leaving the gasification reactor can pass through a portion of the gasification reactor which serves as a disengagement zone where particles too heavy to be entrained by the gas leaving the gasification reactor are returned to the fluidized bed. The disengagement zone can include one or more internal cyclone separators or similar devices for removing particulates from the gas. The gas effluent passing through the disengagement zone and leaving the gasification reactor generally contains $CH_4$, $CO_2$, $H_2$, CO, $H_2S$, $NH_3$, unreacted steam, entrained particles, and other trace contaminants such as COS and HCN.

Residual entrained fines are typically removed by suitable means such as external cyclone separators followed by Venturi scrubbers. The recovered particles can be processed to recover alkali metal catalyst.

The gas stream from which the fines have been removed can then be passed through a heat exchanger to cool the gas and the recovered heat can be used to preheat recycle gas and generate high pressure steam. The gas stream exiting the Venturi scrubbers can be fed to COS hydrolysis reactors for COS removal (sour process) and further cooled in a heat exchanger to recover residual heat prior to entering water scrubbers for ammonia recovery, yielding a scrubbed gas comprising at least $H_2S$, $CO_2$, CO, $H_2$ and $CH_4$. Methods for COS hydrolysis are known to those skilled in the art, for example, see U.S. Pat. No. 4,100,256.

The raw product gas stream from which the fines have been removed can then be passed through a heat exchanger to cool the gas and to remove steam therefrom. The recovered heat can be used, for example, to preheat recycle gas and generate high pressure steam. Residual entrained particles can also be removed by any suitable means such as external cyclone separators followed by Venturi scrubbers. The recovered particles can be processed to recover alkali metal catalyst.

The raw product gas stream can then be sweetened, for example by removing acid gas and sulfur (i.e., sulfur-containing compounds such as COS and $H_2S$) therefrom. For example, the exiting the Venturi scrubbers can be fed to COS hydrolysis reactors for COS removal (sour process) and further cooled in a heat exchanger to recover residual heat prior to entering water scrubbers for ammonia recovery, yielding a scrubbed gas comprising at least $H_2S$, $CO_2$, CO, $H_2$, and $CH_4$.

Methods for COS hydrolysis are known to those skilled in the art, for example, see U.S. Pat. No. 4,100,256.

The residual heat from the scrubbed gas can be used to generate low pressure steam. Scrubber water and sour process condensate can be processed to strip and recover $H_2S$, $CO_2$ and $NH_3$; such processes are well known to those skilled in the art. $NH_3$ can typically be recovered as an aqueous solution (e.g., 20 wt. %).

A subsequent acid gas removal process can be used to remove $H_2S$ and $CO_2$ from the scrubbed gas stream by a physical or chemical absorption method involving solvent treatment of the gas to give a cleaned gas stream. Such processes involve contacting the scrubbed gas with a solvent such as monoethanolamine, diethanolamine, methyldiethanolamine, diisopropylamine, diglycolamine, a solution of sodium salts of amino acids, methanol, hot potassium carbonate or the like. One method can involve the use of Selexol® (UOP LLC, Des Plaines, Ill. USA) or Rectisol® (Lurgi AG, Frankfurt am Main, Germany) solvent having two trains; each train consisting of an $H_2S$ absorber and a $CO_2$ absorber. The spent solvent containing $H_2S$, $CO_2$ and other contaminants can be regenerated by any method known to those skilled in the art, including contacting the spent solvent with steam or other stripping gas to remove the contaminants or by passing the spent solvent through stripper columns. Recovered acid gases can be sent for sulfur recovery processing. The resulting sweetened gas stream typically contains mostly $CH_4$, $H_2$, and CO and, typically, small amounts of $CO_2$ and $H_2O$. Any recovered $H_2S$ from the acid gas removal and sour water stripping can be converted to elemental sulfur by any method known to those skilled in the art, including the Claus process. Elemental sulfur can be recovered as a molten liquid.

Further process details can be had by reference to the previously incorporated publications and applications.

Gasification Catalyst

Gasification processes according to the present invention use a carbonaceous feed material (e.g., a coal and/or a petroleum coke) and further use an amount of a gasification catalyst, for example, an alkali metal component, as alkali metal and/or a compound containing alkali metal, as well as optional co-catalysts, as disclosed in the previous incorporated references. Typically, the quantity of the alkali metal component in the composition is sufficient to provide a ratio of alkali metal atoms to carbon atoms in a molar ratio ranging from about 0.01, or from about 0.02, or from about 0.03, or from about 0.04, to about 0.06, or to about 0.07, or to about 0.08. Further, the alkali metal is typically loaded onto a carbon source to achieve an alkali metal content of from about 3 to about 10 times more than the combined ash content of the carbonaceous material (e.g., coal and/or petroleum coke), on a mass basis.

Suitable alkali metals are lithium, sodium, potassium, rubidium, cesium, and mixtures thereof. Particularly useful are potassium sources. Suitable alkali metal compounds include alkali metal carbonates, bicarbonates, formates, oxalates, amides, hydroxides, acetates, or similar compounds. For example, the catalyst can comprise one or more of $Na_2CO_3$, $K_2CO_3$, $Rb_2CO_3$, $Li_2CO_3$, $Cs_2CO_3$, NaOH, KOH, RbOH or CsOH, and particularly, potassium carbonate and/or potassium hydroxide.

Typically, carbonaceous feedstocks include a quantity of inorganic matter (e.g. including calcium, alumina and/or silica) which form inorganic oxides ("ash") in the gasification reactor. At temperatures above about 500 to 600° C., potassium and other alkali metals can react with the alumina and silica in ash to form insoluble alkali aluminosilicates. In this form, the alkali metal is substantially water-insoluble and inactive as a catalyst. To prevent buildup of the residue in a coal gasification reactor, a solid purge of char residue, i.e., solids composed of ash, unreacted or partially-reacted carbonaceous feedstock, and various alkali metal compounds (both water soluble and water insoluble) are routinely withdrawn. Preferably, the alkali metal is recovered from the char residue for recycle; any unrecovered catalyst is generally compensated by a catalyst make-up stream. The more alumina and silica in the feedstock, the more costly it is to obtain a higher alkali metal recovery.

The ash content of the carbonaceous feedstock can be selected to be, for example, to be about 20 wt % or less, or about 15 wt % or less, or about 10 wt % or less, as are typical for coal; or to be about 1% or less, or about 0.5% or less, or about 0.1% or less, as are typical for petroleum residues including petcoke.

In certain embodiments of the present invention, the gasification catalyst is substantially extracted (e.g., greater than 80%, greater than 90%, or even greater than 95% extraction) from the char residue. Processes have been developed to recover gasification catalysts (such as alkali metals) from the solid purge in order to reduce raw material costs and to minimize environmental impact of a catalytic gasification process. The char residue can be quenched with recycle gas and water and directed to a catalyst recycling operation for extraction and reuse of the alkali metal catalyst. Particularly useful recovery and recycling processes are described in U.S. Pat. No. 4,459,138, as well as previously incorporated U.S. Pat. No. 4,057,512, US2007/0277437A1, U.S. patent application Ser. No. 12/342,554, entitled "CATALYTIC GASIFICATION PROCESS WITH RECOVERY OF ALKALI METAL FROM CHAR", U.S. patent application Ser. No. 12/342,715, entitled "CATALYTIC GASIFICATION PROCESS WITH RECOVERY OF ALKALI METAL FROM CHAR", U.S. patent application Ser. No. 12/342,736, entitled "CATALYTIC GASIFICATION PROCESS WITH RECOVERY OF ALKALI METAL FROM CHAR", and U.S. patent application Ser. No. 12/343,143, entitled "CATALYTIC GASIFICATION PROCESS WITH RECOVERY OF ALKALI METAL FROM CHAR". Reference can be had to those documents for further process details.

In certain embodiments of the invention, at least 70%, at least 80%, or even at least 90% of the water-soluble gasification catalyst is extracted from the char residue.

Methods for Preparing the Carbonaceous Feedstock for Gasification

The carbonaceous feedstock for use in the gasification process can require initial processing.

The carbonaceous feedstock can be crushed and/or ground according to any methods known in the art, such as impact crushing and wet or dry grinding to yield particulates. Depending on the method utilized for crushing and/or grinding of the petroleum coke, the resulting particulates can need to be sized (e.g., separated according to size) to provide an appropriate particle size range of carbonaceous feedstock for the gasifying reactor. The sizing operation can be used to separate out the fines of the carbonaceous feedstock from the particles of carbonaceous feedstock suitable for use in the gasification process.

Any method known to those skilled in the art can be used to size the particulates. For example, sizing can be preformed by screening or passing the particulates through a screen or number of screens. Screening equipment can include grizzlies, bar screens, and wire mesh screens. Screens can be static or incorporate mechanisms to shake or vibrate the screen. Alternatively, classification can be used to separate the particulate carbonaceous feedstock. Classification equipment can include ore sorters, gas cyclones, hydrocyclones, rake classifiers, rotating trommels, or fluidized or entrained flow classifiers. The carbonaceous feedstock can be also sized or classified prior to grinding and/or crushing.

In one embodiment of the invention, the carbonaceous feedstock is crushed or ground, then sized to separate out fines of the carbonaceous feedstock having an average particle size less than about 45 microns from particles of carbonaceous feedstock suitable for use in the gasification process. As described in more detail below, the fines of the carbonaceous feedstock can remain unconverted (i.e., unreacted in a gasification or combustion process), then combined with char residue to provide a carbonaceous fuel of the present invention.

That portion of the carbonaceous feedstock of a particle size suitable for use in the gasifying reactor can then be further processed, for example, to impregnate one or more catalysts and/or cocatalysts by methods known in the art, for example, as disclosed in U.S. Pat. No. 4,069,304 and U.S. Pat. No. 5,435,940; previously incorporated U.S. Pat. No. 4,092,125, U.S. Pat. No. 4,468,231 and U.S. Pat. No. 4,551,155; previously incorporated U.S. patent application Ser. Nos. 12/234,012 and 12/234,018; and previously incorporated U.S. patent application Ser. No. 12/342,565, entitled "PETROLEUM COKE COMPOSITIONS FOR CATALYTIC GASIFICATION", Ser. No. 12/342,608, entitled "PETROLEUM COKE COMPOSITIONS FOR CATALYTIC GASIFICATION", and Ser. No. 12/342,578, entitled "COAL COMPOSITIONS FOR CATALYTIC GASIFICATION".

Conversion of the Sweetened Gas Stream to a Synthesis Gas Stream

The sweetened gas stream can be converted to a synthesis gas stream using any method known to one of skill in the art. For example, in one embodiment of the invention, carbon monoxide and hydrogen are separated from the sweetened gas stream to provide the synthesis gas stream and a methane gas stream. Methods such as cryogenic separation can be used to perform the separation. One method for performing the separation involves the combined use of molecular sieve absorbers to remove residual $H_2O$ and $CO_2$ and cryogenic distillation to provide the methane gas stream and the synthesis gas stream.

In another embodiment of the invention, the sweetened gas stream is reformed to form the synthesis gas stream. In the reforming reaction, methane reacts with steam to form hydrogen and carbon monoxide according to the following equation:

$$H_2O+CH_4 \rightarrow 3H_2+CO$$

In certain embodiments of the invention, the reforming reaction converts substantially all (e.g., greater than about 80%, greater than about 90% or even greater than about 95%) of the methane in the sweetened gas stream to carbon monoxide. The reforming reaction can be performed, for example, at a temperature in the range of from about 1300° F. to about 1800° F. (e.g., about 1550° F.), and at pressures in the range of from about 200 psig to about 500 psig (e.g., about 350 psig). The reforming reaction can be performed, for example, on the catalyst-lined interior of a tube within a steam reforming furnace. The catalyst can be, for example, a metallic constituent supported on an inert carrier. The metallic constituent can be, for example, a metal selected from Group VI-B and the iron group of the periodic table, such as chromium, molybdenum, tungsten, nickel, iron or cobalt. The catalyst can include a small amount of potassium carbonate or a similar compound as a promoter. Suitable inert carriers include silica, alumina, silica-alumina, and zeolites. The reforming reaction can take place within a tube (e.g., shaped in a coil) within a reformer furnace. In certain embodiments of the invention, a second portion of the sweetened gas can be used to fuel the reformer furnace(s). For example, a fraction of the sweetened gas stream ranging from about 15 to about 30% (e.g., about 22%) can be used to fuel the reformer furnace. In another embodiment of the invention, the furnace fuel may be supplemented by natural gas or by combustible tail gas from any of the synthesis reactions disclosed herein.

In some embodiments of the invention, the synthesis gas stream undergoes further processing steps. For example, the synthesis gas stream can be cooled through heat exchange; the recovered heat can be used to heat or generate steam, or to heat another gas stream within the process. The synthesis gas stream can also have its carbon monoxide/hydrogen ratio adjusted. In one embodiment of the invention, the carbon monoxide/hydrogen ratio of the synthesis gas stream is adjusted by raising the carbon monoxide/hydrogen ratio by reacting carbon dioxide with hydrogen to form carbon monoxide and water. This so-called back shift reaction can be performed, for example, at a temperature in the range of from about 300 to about 550° F. (e.g., 412° F.) in an atmosphere including carbon dioxide. The person of skill in the art can determine the appropriate reaction conditions for the back shift reaction.

Syngas-Derived Products

In the processes according to the present invention, the synthesis gas stream is conveyed to a syngas reaction zone, in which it is reacted to form a syngas-derived product. A syngas-derived product is a product formed from the reaction of syngas, in which carbon from the synthesis gas carbon monoxide is incorporated. The syngas-derived product can itself be a final, marketable product; it can also be an intermediate in the synthesis of other products. The syngas reaction zone is the area or collection of one or more apparatuses in which the synthesis gas stream is converted to the syngas-derived product; it can include one or more reactors, pre-processing apparatuses, gas purification apparatuses, etc. As the person of skill in the art will appreciate, synthesis gas can be used as a feedstock in a wide variety of reactions to form a wide variety of syngas-derived products. For example, the syngas-derived product can be used to make compounds having two or more carbons, such as, for example, one or more hydrocarbons, one or more oxyhydrocarbons, and mixtures thereof. The syngas-derived product can be, for example, methanol, ethanol, dimethyl ether, diethyl ether, methyl t-butyl ether, acetic acid, acetic anhydride, linear paraffins, iso-paraffins, linear olefins, iso-olefins, linear alcohols, linear carboxylic acids, aromatic hydrocarbons; Fischer-Tropsch diesel fuel, jet fuel, other distillate fuel, naphtha, wax, lube base stock, or lube base feed stock; or syncrude. The reaction of the synthesis gas can produce heat energy, a combustible tail gas mixture, or both.

In embodiments of the invention in which the reaction of the synthesis gas forms heat energy, the heat energy can be recovered and used, for example, in a preceding process step or in other applications. For example, the heat energy can be used in the conversion of the carbonaceous feedstock to the synthesis gas stream. The heat energy can be used to generate or heat steam, which can be used in the conversion process or in other applications. In embodiments of the invention in which the reaction of the synthesis gas also forms a combustible tail gas mixture (e.g., comprising hydrogen, hydrocarbons, or a mixture thereof), the combustible tail gas mixture can be burned to generate or further heat the steam. The steam can be used in the conversion of the carbonaceous feedstock; for example, it can be used in a catalytic gasification reaction within the syngas formation zone, as described above; added to the sweetened gas stream in a reforming step, as described above; and/or used to dry a carbonaceous feedstock (e.g., after catalyst loading), as described above. The steam can also be driven through a turbine for the generation of electrical power, which can be used within the plant or sold. As the person of skill in the art will appreciate, the recovered heat energy from the reaction of the synthesis gas stream, or steam generated therefrom or heated thereby, can be used in other applications not specifically detailed herein.

In certain embodiments of the invention, the reaction of the synthesis gas stream forms a combustible tail gas mixture (e.g., as a by-product). The combustible tail gas mixture can comprise, for example, hydrogen, hydrocarbons, oxyhydrocarbons, or a mixture thereof. The combustible tail gas mixture can be burned to provide heat energy, which can be recovered and used, for example, in a preceding process step, or for some other application. For example, in one embodiment of the invention, the combustible tail gas mixture is used to fire a reforming furnace. The combustible tail gas mixture can also be burned to generate or heat steam. The steam can be used in a preceding process step; for example, it can be provided to the gasification reactor for reaction with the carbonaceous feedstock, as described above; added to the sweetened gas stream in the formation of one or both of the reformer input gas streams, as described above; and/or used to dry the carbonaceous feedstock (e.g., after catalyst loading), as described above. The steam can also be driven through a turbine for the generation of electrical power, which can be used within the plant or sold. As the skilled artisan will appreciate, the heat energy generated by burning the combustible tail gas mixture, or steam generated therefrom or heated thereby, can be used in other applications not specifically detailed herein.

I claim:

1. A process of making a syngas-derived product from a carbonaceous feedstock, the process comprising the steps of:

(a) providing a carbonaceous feedstock;

(b)(i) reacting the carbonaceous feedstock in a gasification reactor in the presence of steam and a gasification catalyst under suitable temperature and pressure to form a raw product gas stream comprising a plurality of gases comprising methane, hydrogen, carbon monoxide, carbon dioxide, hydrogen sulfide, ammonia and steam;

(b)(ii) removing steam and ammonia from and sweetening the raw product gas stream to form a sweetened gas stream;

(b)(iii) separating carbon monoxide and hydrogen from the sweetened gas stream to provide a synthesis gas stream and a methane gas stream, wherein the synthesis gas stream comprises hydrogen and carbon monoxide;

(c) conveying the synthesis gas stream to a syngas reaction zone;

(d) reacting the synthesis gas stream in the syngas reaction zone to form the syngas-derived product and heat energy;

(e) recovering the syngas-derived product; and (f) recovering the heat energy formed from the reaction of the synthesis gas stream.

2. The process of claim 1, wherein the heat energy is used to generate or heat steam.

3. The process of claim 2, wherein the reaction of the synthesis gas further forms a combustible tail gas mixture; and wherein the combustible tail gas mixture is burned to further heat the steam.

4. The process of claim 3, wherein the steam is driven through a turbine for the generation of electrical power.

5. The process of claim 2, wherein the steam is used in step b(i).

6. A process of making a syngas-derived product from a carbonaceous feedstock, the process comprising the steps of:

(a) providing a carbonaceous feedstock;

(b)(i) reacting the carbonaceous feedstock in a gasification reactor in the presence of steam and a gasification catalyst under suitable temperature and pressure to form a raw product gas stream comprising a plurality of gases comprising methane, hydrogen, carbon monoxide, carbon dioxide, hydrogen sulfide, ammonia and steam;

(b)(ii) removing steam and ammonia from and sweetening the raw product gas stream to form a sweetened gas stream;

(b)(iii) separating carbon monoxide and hydrogen from the sweetened gas stream to provide a synthesis gas stream and a methane gas stream, wherein the synthesis gas stream comprises hydrogen and carbon monoxide;

(c) conveying the synthesis gas stream to a syngas reaction zone;

(d) reacting the synthesis gas stream in the syngas reaction zone to form the syngas-derived product and a combustible tail gas mixture;

(e) recovering the syngas-derived product; and (f) burning the combustible tail gas mixture to provide heat energy.

7. The process of claim 6, wherein the combustible tail gas mixture is burned to heat steam.

8. The process of claim 7, wherein the steam is driven through a turbine for the generation of electrical power.

9. The process of claim 7, wherein the steam is used in step b(i).

10. A process of making a syngas-derived product from a carbonaceous feedstock, the process comprising the steps of:

(a) providing a carbonaceous feedstock;

(b)(i) reacting the carbonaceous feedstock in a gasification reactor in the presence of steam and a gasification catalyst under suitable temperature and pressure to form a raw product gas stream comprising a plurality of gases comprising methane, hydrogen, carbon monoxide, carbon dioxide, hydrogen sulfide, ammonia and steam;

(b)(ii) removing steam and ammonia from and sweetening the raw product gas stream to form a sweetened gas stream;

(b)(iii) reforming the sweetened gas stream to form a synthesis gas stream comprising hydrogen and carbon monoxide;

(c) conveying the synthesis gas stream to a syngas reaction zone;

(d) reacting the synthesis gas stream in the syngas reaction zone to form the syngas-derived product and heat energy;

(e) recovering the syngas-derived product; and (f) recovering the heat energy formed from the reaction of the synthesis gas stream.

11. The process of claim 10, wherein the heat energy is used to generate or heat steam.

12. The process of claim 11, wherein the reaction of the synthesis gas further forms a combustible tail gas mixture; and wherein the combustible tail gas mixture is burned to further heat the steam.

13. The process of claim 12, wherein the steam is driven through a turbine for the generation of electrical power.

14. The process of claim 11, wherein the steam is used in step b(i).

15. A process of making a syngas-derived product from a carbonaceous feedstock, the process comprising the steps of:

(a) providing a carbonaceous feedstock;

(b)(i) reacting the carbonaceous feedstock in a gasification reactor in the presence of steam and a gasification catalyst under suitable temperature and pressure to form a raw product gas stream comprising a plurality of gases comprising methane, hydrogen, carbon monoxide, carbon dioxide, hydrogen sulfide, ammonia and steam;

(b)(ii) removing steam and ammonia from and sweetening the raw product gas stream to form a sweetened gas stream;

(b)(iii) reforming the sweetened gas stream to form a synthesis gas stream comprising hydrogen and carbon monoxide;

(c) conveying the synthesis gas stream to a syngas reaction zone;

(d) reacting the synthesis gas stream in the syngas reaction zone to form the syngas-derived product and a combustible tail gas mixture;

(e) recovering the syngas-derived product; and (f) burning the combustible tail gas mixture to provide heat energy.

16. The process of claim 15, wherein the combustible tail gas mixture is burned to heat steam.

17. The process of claim 16, wherein the steam is driven through a turbine for the generation of electrical power.

18. The process of claim 16, wherein the steam is used in step b(i).

* * * * *